US008791685B2

(12) United States Patent
Cho et al.

(10) Patent No.: US 8,791,685 B2
(45) Date of Patent: Jul. 29, 2014

(54) BANDGAP REFERENCE VOLTAGE GENERATOR

(71) Applicant: Electronics and Telecommunications Research Institute, Daejeon (KR)

(72) Inventors: Young Kyun Cho, Daejeon (KR); Jae Ho Jung, Daejeon (KR); Kwang Chun Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 14/098,989

(22) Filed: Dec. 6, 2013

(65) Prior Publication Data

US 2014/0159700 A1 Jun. 12, 2014

(30) Foreign Application Priority Data

Dec. 6, 2012 (KR) ..... 10-2012-0140935

(51) Int. Cl.
*G05F 3/30* (2006.01)
*G05F 3/26* (2006.01)

(52) U.S. Cl.
USPC ..... 323/314; 323/316; 327/541

(58) Field of Classification Search
USPC ..... 323/312–317; 327/539–543
See application file for complete search history.

(56) References Cited

U.S. PATENT DOCUMENTS

| | | | | |
|---|---|---|---|---|
| 7,253,597 | B2 * | 8/2007 | Brokaw | 323/314 |
| 7,399,116 | B2 * | 7/2008 | Takeuchi | 374/1 |
| 7,821,320 | B2 * | 10/2010 | Ueda | 327/512 |
| 7,990,130 | B2 * | 8/2011 | Yoshikawa | 323/313 |
| 2006/0208790 | A1 * | 9/2006 | Tadeparthy et al. | 327/541 |
| 2010/0052643 | A1 | 3/2010 | Cho et al. | |

FOREIGN PATENT DOCUMENTS

KR 10-2010-0026839 3/2010

OTHER PUBLICATIONS

Guan, Xiaokang et al., "A 3 V 110 uW 3.1 ppm/C curvature-compensated CMOS bandgap reference," Analog Integr. Circ. Sig. Process, vol. 62:113-119 (2010).

* cited by examiner

*Primary Examiner* — Jessica Han
(74) *Attorney, Agent, or Firm* — Nelson Mullins Riley & Scarborough LLP

(57) ABSTRACT

Disclosed is a bandgap reference voltage generator insensitive to changes of process, voltage, and temperature. A bandgap reference voltage generator may detect current having characteristic of CTAT and current having characteristic of PTAT which flow in a current compensation part included in an amplification part, and provide body voltage to one of two input transistors included in the amplification part in response to ratio of the two currents when the ratio is different from the preconfigured reference value. Thus, characteristics according to changes of parameters of elements and change of offset of the amplification part due to changes of PVT may be enhanced, and a characteristic of power supply rejection ratio (PSRR) may be enhanced.

6 Claims, 7 Drawing Sheets

FIG. 5

| | CONVENTIONAL TECHNOLOGIES | | | | | THE PRESENT INVENTION | | | | |
|---|---|---|---|---|---|---|---|---|---|---|
| PROCESS | FF | FS | TT | SF | SS | FF | FS | TT | SF | SS |
| SUPPLY(V) | 1.32 | 1.2 | 1.2 | 1.2 | 1.08 | 1.32 | 1.2 | 1.2 | 1.2 | 1.08 |
| TEMPERATURE RANGE (℃) | -40~120 | | | | | | | | | |
| $V_{REF}$(mV) | 715.3 | 714.8 | 715.5 | 714.8 | 715.1 | 715.3 | 715.2 | 715.5 | 715.7 | 715.4 |
| △BGR(mV) | 1.75 | 0.75 | 0.60 | 1.26 | 2.68 | 0.50 | 0.35 | 0.26 | 0.56 | 0.87 |
| TC(ppm/℃) | 23.4 | 10.9 | 5.2 | 6.5 | 15.3 | 4.4 | 3.0 | 2.3 | 4.8 | 7.6 |
| PSRR@100kHZ(dB) | 61.1 | 57.6 | 53.5 | 56.2 | 36.8 | 68.9 | 64.8 | 60.3 | 48.9 | 40.1 |
| POWER(μW) | 119 | 91 | 76 | 77 | 73 | 109 | 85 | 79 | 73 | 59 |

I - I'

BANDGAP REFERENCE VOLTAGE GENERATOR

CLAIM FOR PRIORITY

This application claims priority to and the benefit of Korean Patent Application No. 10-2012-0140935 filed on Dec. 6, 2012 in the Korean Intellectual Property Office (KIPO), the entire contents of which are hereby incorporated by reference.

BACKGROUND

1. Technical Field

Example embodiments of the present invention relate to a reference voltage generator, and more specifically to a bandgap reference voltage generator insensitive to changes of process, voltage, and temperature.

2. Related Art

Almost of analog, high-frequency, and digital circuits made in a chip form needs stable and precise bias voltages in order to enhance operation efficiency.

However, a bias voltage provided from general bias circuits may not maintain a constant voltage according to changes of process, voltage, and temperature (PVT). In order to overcome the above problem, a bandgap reference voltage generator designed to be insensitive to changes of PVT is being used.

Usually, bandgap reference voltage generators may use voltage between a base and an emitter of bipolar transistor, since temperature characteristics of the voltage between a base and an emitter of bipolar junction transistor (BJT) is more excellent than those of metal oxide semiconductor (MOS) transistor such as threshold voltage and mobility.

Thus, performance of bandgap reference voltage generator using BJT is limited by non-linearity of the voltage between base and emitter of the BJT, and thereby various curvature compensation techniques have been proposed in order to enhance performances of bandgap reference voltage generators using BJT. Most of the curvature compensation techniques focus upon attenuating non-linearity of the voltage between base and emitter.

Meanwhile, even though temperature characteristics of the BJT are more excellent than those of MOS transistor, characteristics according to changes of process and power supply voltage may not be guaranteed.

For example, a Korean published application 10-2010-0026389 filed by the present applicant disclosed a bandgap reference voltage generator having an excellent temperature coefficients 9 ppm/ in the case of general Typical-Typical (TT) process condition. However, the above bandgap reference voltage generator has temperature coefficients 48.3 ppm/ and 138.8 ppm/ respectively for Fast-Fast (FF) process condition and Slow-Slow (SS) process condition. That is, the bandgap reference voltage generator disclosed in the above published application KR 10-2010-0026839 has a problem that temperature compensation according to changes of process is not performed appropriately in process conditions except the TT process condition, and so the above bandgap reference voltage generator has similar performance in process conditions except the TT process condition.

In order to resolve the above problem, a method of preventing performance degradation by control values of resistors constituting bandgap reference voltage generator has been proposed, since changes of characteristics according to changes of process and power supply voltage are most severe in resistors. However, the above method needs a plurality of resistors to compensate resistance value which varies more than 30 percent according to process and a plurality of fuse circuits connected to each of resistors in parallel. Therefore, large area on a chip is needed to implement the above method, and there are difficulties to control the resistance values minutely and limits in obtaining optimized performances.

SUMMARY

Accordingly, example embodiments of the present invention are provided to substantially obviate one or more problems due to limitations and disadvantages of the related art.

Example embodiments of the present invention provide a bandgap reference voltage generator implementation of which is simple and which can minimize changes of characteristics according to process, voltage, and temperature.

In some example embodiments, a bandgap reference voltage generator may include a current source part configured as current minor to provide a first current, a second current, and a third current; a first current compensation part generating a first node voltage according to the first current and compensating a change of current due to changes of at least one of process, voltage, and temperature (PVT); a second current compensation part generating a second node voltage according to the second current and compensating a change of current due to changes of at least one of process, voltage, and temperature (PVT) by generating a fourth current and a fifth current which have change characteristics opposite to each other according to change of absolute temperature; an amplification part comprising a first input transistor which receives the first node voltage through its gate and a second input transistor which receives the second node voltage through its gate, and outputting a voltage to drive the current source part according the first node voltage and the second node voltage; a voltage providing part detecting amount of change in the fourth current and the fifth current, and providing body voltage to one of the first input transistor and the second input transistor according to the detected amount of change; and an output part outputting reference voltage according to the third current.

Here, the voltage providing part may further comprise a current detecting part detecting amount of change in the fourth current and the fifth current, and generating body voltage control signal including information indicating one of the first input transistor and the second input transistor to which the body voltage is provided and information on level of the body voltage; and a body voltage control part providing the body voltage to one of the first input transistor and the second input transistor according to the body voltage control signal.

Here, the voltage providing part may compare a ratio of the fourth current and the fifth current with a preconfigured reference value, and provide the body voltage to the second input transistor when the ratio is above the reference value.

Here, the voltage providing part may compare a ratio of the fourth current and the fifth current with a preconfigured reference value, and provide the body voltage to the first input transistor when the ratio is below the reference value.

Here, the amplification part may comprise a third PMOS transistor and a fourth PMOS transistor configured as a current-mirror, and respective sources of the third and the fourth PMOS transistors may be connected to power supply voltage, and respective drains of the third and the fourth PMOS transistors may be connected to respective drains of the first and the second input transistors, and a drain of the fourth PMOS transistor may be connected to the current source part, and the voltage to drive the current source part may be changed according to the body voltage provided to one of the first input transistor and the second input transistor.

Here, the first input transistor and the second input transistor may be NMOS transistors, and respective NMOS transistor in which a P+ region provided with the body voltage and a deep N-well isolating the P+ region from P-type substrate.

BRIEF DESCRIPTION OF DRAWINGS

Example embodiments of the present invention will become more apparent by describing in detail example embodiments of the present invention with reference to the accompanying drawings, in which:

FIG. 5 is a table to show environment and result of performance evaluation for a bandgap reference voltage generator according to an example embodiment of the present invention;

DESCRIPTION OF EXAMPLE EMBODIMENTS

Figure 1:
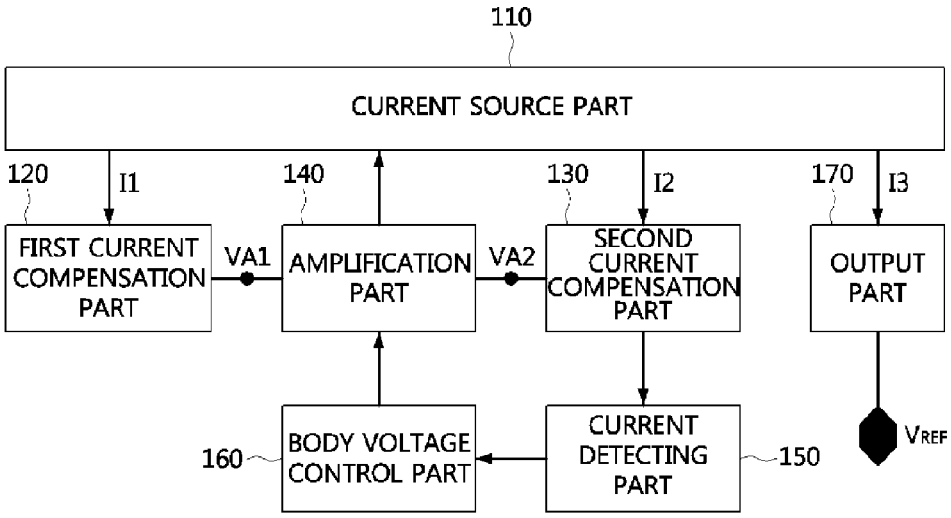
FIG. 1 is a block diagram to show a configuration of bandgap reference voltage generator according to an example embodiment of the present invention.

Example embodiments of the present invention are disclosed herein. However, specific structural and functional details disclosed herein are merely representative for purposes of describing example embodiments of the present invention, however, example embodiments of the present invention may be embodied in many alternate forms and should not be construed as limited to example embodiments of the present invention set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram to show a configuration of bandgap reference voltage generator according to an example embodiment of the present invention.

Referring to FIG. 1, a bandgap reference voltage generator may include a current source part 110, a first current compensation part 120, a second current compensation part 130, an amplification part 140, a current detecting part 150, a body voltage control part 160, and an output part 170.

The current source part 110 may be configured as current minor comprising a plurality of metal oxide semiconductor (MOS) transistors, and may provide the same currents—a first current I1, a second current I2, and a third current I3 to the first current compensation part 120, the second current compensation part 130, and the output part 170 in response to an output voltage provided from the amplification part 140.

The first current compensation part 120 may generate a first node voltage (VA1) based on the current I1 provided from the current source part 110, provide the first node voltage (VA1) to a first input of the amplification part 140, and compensate changes of current due to changes of PVT.

The second current compensation part 130 may generate a second node voltage (VA2) based on the current I2 provided from the current source part 110, provide the second node voltage (VA2) to a second input of the amplification part 140, and compensate changes of current due to changes of PVT. Here, the current I2 which flows in the second current compensation part 130 is identical to the current I3 which flows in the output part 170 through current minoring of the current source part 110.

The first input of the amplification part 140 is connected to the first current compensation part 120, the second input of the amplification part 140 is connected to the second current compensation part 130, and the output of the amplification part 140 is connected to the current source part 110. The amplification part 140 may perform a negative feedback to the current source part 110 in response to the first node voltage (VA1) and the second node voltage (VA2). Here, the first and the second inputs of the amplification part 140 may be NMOS transistors. The first node voltage (VA1) and the second voltage (VA2) may be provided to gates of the NMOS transistors respectively.

Also, two MOS transistors constituting input part of the amplification part 140 may be configured that the body voltages of the two MOS transistors vary in response to body voltage provided from the body voltage control part 160, and change the first node voltage (VA1) and the second node voltage (VA2).

The current detecting part 150 may monitor complementary-to-absolute temperature (CTAT) current and proportional-to-absolute temperature (PTAT) current which flow in the second current compensation part. The current detecting part 150 may compare a ratio of the CTAT current and the PTAT current with a preconfigured reference value, and providing body voltage control signal to the body voltage control part 160 in order to control body voltage of corresponding MOS transistor among the two input MOS transistors. Here, the body voltage control signal may information indicating MOS transistor to control body voltage and information on level of the body voltage.

The body voltage control part 160 may provide body voltage having a level according to the body voltage control signal to corresponding input MOS transistor among two input MOS transistors of the amplification part 140 in response to the body voltage control signal provided from the current detecting part 150.

The output part 170 may be provided with the current I3 identical to the current I2 flowing in the second current compensation part 130 from the current source part 110, and may output a reference voltage $V_{REF}$ in response to the current I3.

Figure 2:
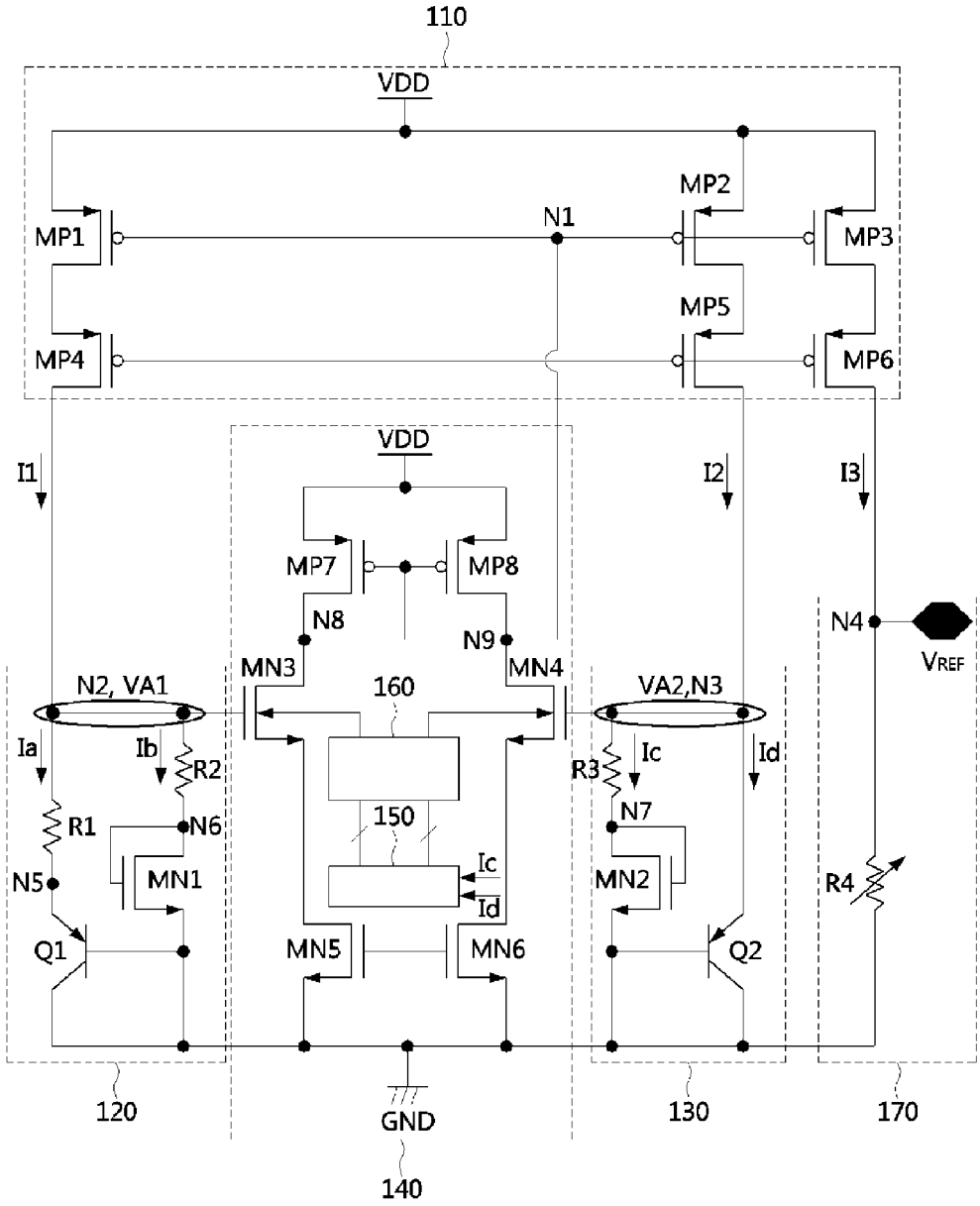
FIG. 2 is a circuit diagram to show a more detail constitution of the bandgap reference voltage generator shown in FIG. 1.

FIG. 2 is a circuit diagram to show a more detail constitution of the bandgap reference voltage generator shown in FIG. 1. FIG. 2 shows an example of various circuit configurations to implement the bandgap reference voltage generator depicted in FIG. 1. However, the present invention is not limited by the configuration of a specific example shown in FIG. 2.

Referring to FIG. 2, the current source part 110 may be configured as a current minor comprising a first to a third PMOS transistor MP1 to MP3. Gates of the first to the third PMOS transistor MP1 to MP3 are commonly connected to a first node N1, and sources of them are commonly connected to a power supply terminal VDD. Drains of them are respectively connected to sources of a fourth to a sixth PMOS transistor MP4 to MP6. Gates of the fourth to the sixth PMOS transistors MP4 to MP6 are connected commonly, and drains of them are respectively connected to a second node N2, a third node N3 and a fourth node N4.

As shown in FIG. 2, the current source part 110 may be configured as a layered current mirror comprising two layers with the PMOS transistors MP4 to MP6. Since the PMOS transistors MP4 to MP6 may not be configured as layered due to a small design margin in the case that the power supply voltage is low, low-threshold MOSFET may be used for the fourth to the sixth PMOS transistors MP4 to MP6.

Also, as shown in FIG. 2, when the current source part 110 is configured as a two-layer current minor, a loop gain of the circuit may be increased so as to enhance Power Supply Rejection Ratio (PSRR) characteristic of the circuit.

The first current compensation part 120 may comprise a first resistor R1, a second resistor R2, a first bipolar transistor Q1 and a first NMOS transistor NM1. The first resistor R1 may be connected to a point between the second node N2 and the fifth node N5. An emitter of the first bipolar transistor Q1 may be connected to the fifth node N5, and a collector and a base of the first bipolar transistor Q1 may be connected to a ground terminal GND. The first resistor R2 may be connected to a point between the second node N2 and the sixth node N6. A drain and a source of the first NMOS transistor MN1 may be respectively connected to the sixth node N6 and the ground terminal GND, and a gate of the first NMOS transistor may be connected to the sixth node N6.

The second current compensation part 130 may comprise a third resistor R3, a second NMOS transistor MN2, and a second bipolar transistor Q2. The third resistor R3 may be connected to a point between the third node N3 and a seventh node N7. A drain and a source of the second NMOS transistor MN2 may be respectively connected to the seventh node N7 and the ground terminal GND, and a gate of the second NMOS transistor MN2 is connected to the seventh node N7. An emitter of the second bipolar Q2 may be connected to the third node N3, and a collector and a base of it may be the ground terminal GND.

The amplification part 140 may comprise a seventh and a eighth PMOS transistors MP7 and MP8 and a third to a sixth NMOS transistors MN3 to MN6. The seventh and eighth PMOS transistors may be configured as a current minor. That is, sources of the seventh and eighth PMOS transistors MP7 and MP8 are commonly connected to the power supply voltage VDD, and gates of them are commonly connected to an eighth node N8. Drains of them may be respectively connected to the eighth node N8 and a ninth node N9. Here, the ninth node N9 and the first node N1 may be connected.

Drains of the third and the fourth NMOS transistors MN3 and MN4 may be respectively connected to the eighth node N8 and the ninth node N9, and sources of them may be respectively connected to drains of the fifth and the sixth NMOS transistors MN5 and MN6. Also, gates of the third and the fourth NMOS transistors MN3 and MN4 may be respectively connected to the second node N2 and the third node N3. Meanwhile, gates of the fifth and sixth NMOS transistors MN5 and MN6 may be commonly connected, and sources of them may be connected to the ground terminal GND.

The current detecting part 150 may be connected to the second current compensation part 130 to be provided with the CTAT current Ic and the PATT current Id as inputs. Here, the current detecting part 150 may be configured to detect a ratio of the two currents ($I_C$ and $I_d$) by using common various circuit techniques, and may output a plurality of bits in response to a change if the ratio of the two currents, for example, a body voltage control signal.

An input of the body voltage control part 160 may be an output of the current detecting part 150. An output of the body voltage control part 160 may be connected to body terminals of the third and the fourth NMOS transistors MN3 and MN4.

The output part 170 may comprise a fourth resistor R4 connected to a point between the fourth node N4 and the ground terminal GND, and the fourth node N4 may be connected to a node to output a reference voltage $V_{REF}$.

Hereinafter, referring to the bandgap reference voltage generator depicted in FIG. 2, an operation of the bandgap reference voltage generator will be explained.

First, while the first to the third PMOS transistors MP1 to MP3 are in saturation mode, an output voltage of the amplification part 140 may be applied to gates of the first, second, and third PMOS transistors MP1, MP2, and MP3, and currents flowing in the first to the third PMOS transistors MP1 to MP3 may be identical by current mirroring, that is, I1=I2=I3. Here, the current I1 may be divided to Ia and Ib when flowing through the second node N2, that is, I1=Ia+Ib. Also, the current I2 may be divided to Ic and Id when flowing through the third node N3, that is, I2=Ic+Id.

Also, a first node voltage VA1 as voltage of the second node N2 and a second node voltage VA2 as voltage of the third node N3 may have the same value by current mirroring of I1 and I2, and thereby Ia=Id, Ib=Ic when the second resistor R2 is the same as the third resistor R3.

Here, since the current Id flowing in the second bipolar transistor Q2 may be identical to the current Ia, and the current Ia may be proportional to thermal voltage proportional to absolute temperature, the current Id may have a characteristic of PATT.

On the other hand, the current Ic may be a function of difference between base-emitter voltage of the second bipolar transistor Q2 and a threshold voltage of the second NMOS transistor MN2, and thereby the current Ic may have a characteristic of CTAT.

That is, in the bandgap reference voltage generator, since a PTAT voltage proportional to absolute temperature may be a thermal voltage, and a CTAT voltage inversely proportional to absolute temperature may be a difference between base-emitter voltage of the second bipolar transistor Q2 and a threshold voltage of the second NMOS transistor NM2, the current Ic may have a characteristic of CTAT, and the current Id may have a characteristic of PTAT.

Here, if weight values on temperature coefficients of the PTAT voltage and the CTAT voltage are selected appropriately so as to adjust the temperature coefficients to zero, the current Ic having CTAT characteristic and the current Id having PTAT characteristic may be maintained to be the same, and thereby the reference voltage $V_{REF}$, which is insensitive to change of temperature, may be obtained.

As explained above, the bandgap reference voltage generating circuit is configured to perform additional curvature compensation according to threshold voltages of the first NMOS transistor MN1 and the second NMOS transistor MN2. However, if process condition changes, characteristics of elements respectively connected to the second node N2 and the third node N3 change, and so the above condition Ic=Id cannot be satisfied and the temperature compensation operation may not be performed normally.

For example, it is assumed that elements were made in Fast-Fast (FF) process condition, all of threshold voltages of the first and the second NMOS transistors MN1, MN2, resistances of the first to the third resistors R1, R2, and R3, and common-emitter current gain determining output currents of the first and the second bipolar transistors Q1, Q2 may decrease. Here, if the common-emitter current gain decreases, the output current Id of the second bipolar transistor Q2 may decrease, and the current Ic flowing through the second NMOS transistor MN2 acting a role of diode with the third resistor R3 may increase.

That is, according to changes of process condition, the current Ic increases and the current Id decreases. Thereby, temperature compensation may not be performed correctly.

Therefore, in order to overcome un-balance of the currents Ic and Id as described above, the current Id should be increased or the current Ic should be decreased. To decrease the current Ic, it is necessary to perform trimming on resistance of the third resistor R3 or the second NMOS transistor. However, many problems may be occurred by the trimming, it is preferable a method to increase the current Id.

Meanwhile, since the current Id is exponentially proportional to the second node voltage VA2, both the current Ic and the current Id may increase as the second node voltage VA2 increases. However, since the amount of increase of the current Id is much larger than that of the current Ic, ratio of the currents Ic and Id may be maintained in ideal by increasing voltage a little.

In a bandgap reference voltage generator according to an example embodiment of the present invention, in order to user the above described characteristic, a characteristic of temperature compensation due to changes of PVT may be maintained normal by using the current detecting part 150 and the body voltage control part 160, and deterioration of characteristics in the whole circuit due to offset of the amplification part 140 may be compensated.

Hereinafter, when the process condition and power supply voltage change, a method of compensating characteristic deterioration by adjusting body voltage will be explained in detail.

First, the current detecting part 150 may detect the current Ic having CTAT characteristic and the current Id having PTAT characteristic flowing in the second current compensation part 130, compare a ratio of Ic and Id with a preconfigured reference value, and provide body voltage control signal for increasing body voltage of the fourth NMOS transistor MN4 to the body voltage control part 160 in order to increase the first and the second node voltages VA1 and VA2 when the ratio of Ic and Id is above the preconfigured reference value. Here, the body voltage control signal may include information on the level of body voltage which will be applied to the fourth NMOS transistor MN4.

If the body voltage of the fourth NMOS transistor increases, a threshold voltage of the fourth NMOS transistor decreases, and drain current of the fourth NMOS transistor increases so as to decrease an output voltage provided to the first node N1. If voltage of the first node N1 decreases, gate-source voltages of the first and the second PMOS transistors MP1, MP2 increases, and so the currents I1 and I2 increase so as to increase the first and the second node voltages VA1 and VA2.

The increased first and second node voltages VA1 and VA2 may increase the currents Id and Ic. However, since the amount of increase of the current Id is much larger than that of the current Ic as explained above, a ratio of the two currents may be set to identical to the preconfigured reference value (that is, ideal value).

On the other hand, the current detecting part 150 may provide body voltage control signal for increasing body voltage of the third NMOS transistor MN3 to the body voltage control part 160 in order to decrease the first and the second node voltages VA1 and VA2 when the ratio of Ic and Id is below the preconfigured reference value. Here, the body voltage control signal may include information on the level of body voltage which will be applied to the third NMOS transistor MN3.

The body voltage control part 160 may provide body voltage to one of the third and the fourth NMOS transistors MN3, MN4 in response to the body voltage control signal provided from the detecting part 150. Here, the body voltage control part 160 may provide body voltage having the voltage level indicated by the body voltage control signal to the NMOS transistor indicated by the body voltage control signal.

Figure 3:
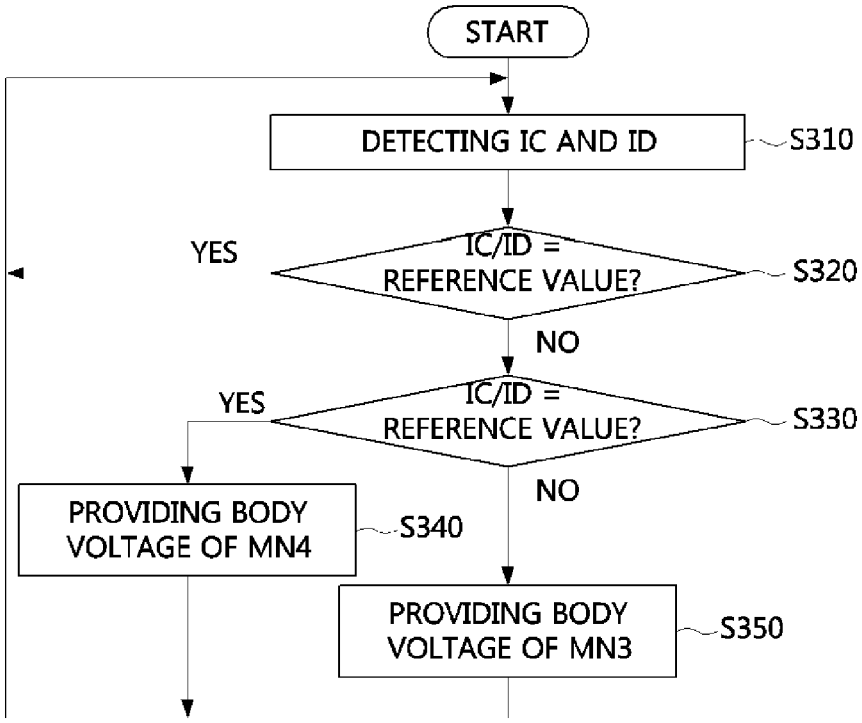
FIG. 3 is a flow chart to show an operation method of a bandgap reference voltage generator according to an example embodiment of the present invention.

FIG. 3 is a flow chart to show an operation method of a bandgap reference voltage generator according to an example embodiment of the present invention, and shows a procedure of compensating characteristics due to changes of PVT and offset of the amplification part 140, which is performed in the bandgap reference voltage generator depicted in FIG. 1 and FIG. 2.

First, the bandgap reference voltage generator may detect amounts of a CTAT current Ic and a PTAT current Id at S310, compare a ratio of the currents Id and Id with a preconfigured reference value, and determine whether the ratio of the currents Id and Id is identical to the preconfigured reference value at S320.

The bandgap reference voltage generator may determine whether the ratio of the currents Id and Id is above or below the preconfigured reference value when the ratio of the currents Id and Id is not identical to the preconfigured reference value at 5330.

In the case that the ratio of the currents Id and Id is above the preconfigured reference value, the bandgap reference voltage generator may increase body voltage of the fourth NMOS transistor MN4 in order to increase the first and the second node voltages VA1 and VA2 at S340. Here, the level of the body voltage provided to the fourth NMOS transistor may be controlled variably according to amount of changes of the ratio, or a difference between the ratio and the reference value.

Or, in the case that the ratio of the currents Id and Id is below the preconfigured reference value, the bandgap reference voltage generator may increase body voltage of the third NMOS transistor MN3 in order to decrease the first and the second node voltages VA1 and VA2 at S350. Here, the level of the body voltage provided to the third NMOS transistor MN3 may be controlled variably according to amount of changes of the ratio, or a difference between the ratio and the reference value.

Figure 4A:
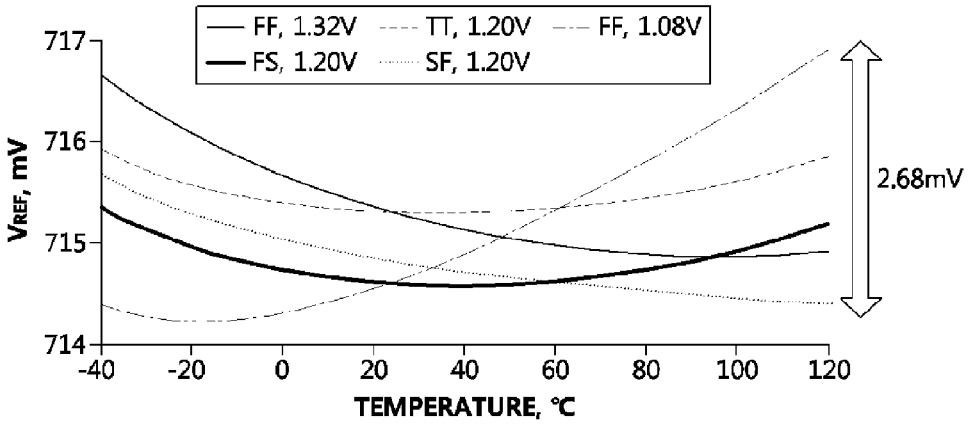
FIG. 4A and FIG. 4B is a graph to show compensation characteristic on changes of temperature in a bandgap reference voltage generator according to an example embodiment of the present invention.
Figure 4B:
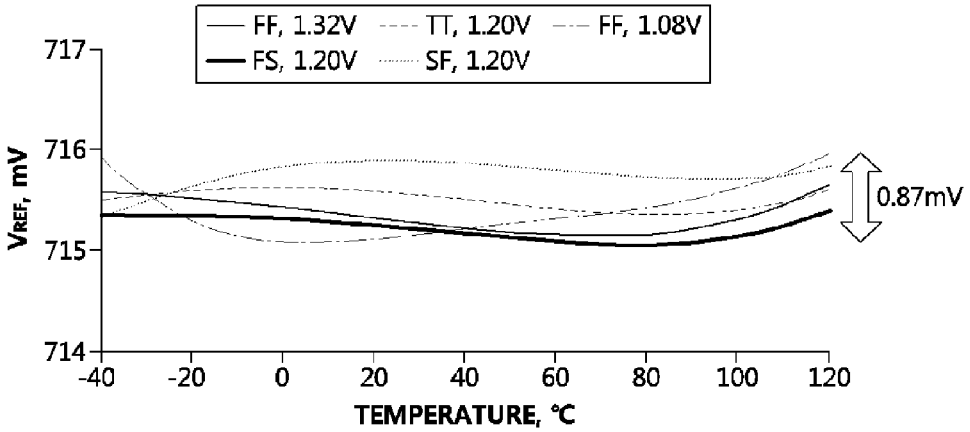

FIG. 4A and FIG. 4B is a graph to show a compensation characteristic on changes of temperature in a bandgap reference voltage generator according to an example embodiment of the present invention. Also, FIG. 5 is a table to show environment and result of performance evaluation for a bandgap reference voltage generator according to an example embodiment of the present invention.

Referring to FIG. 4A, FIG. 4B and FIG. 5, FIG. 4A represents characteristic curves of reference voltages $V_{REF}$ according to PVT changes of the conventional bandgap reference voltage generators, and FIG. 4B represents a characteristic curve of reference voltage $V_{REF}$ according to PVT changes of the bandgap reference voltage generator according to an example embodiment of the present invention.

In order to check characteristics for various process conditions and power supply voltages, five corner conditions such as (FF—1.32V), (TT—1.2V), (SS—1.08V), (SF—1.2V) and (FS—1.2V) may be used for the performance evaluation.

Comparing FIG. 4A with FIG. 4B, although the conventional bandgap reference voltage generators have excellent characteristics in the condition of (TT—1.2V), it can be found that a temperature characteristic rapidly increases due to changes of the process condition and the power supply voltage. However, it can be found that the bandgap reference voltage generator according to an example embodiment of the present invention maintains temperature characteristic consistently in other corner conditions as well as in the condition of (TT—1.2V).

That is, when the performance evaluation is performed in the temperature range of −40 degree to 120 degree, the change amount of temperature characteristic of the conventional bandgap reference voltage generator is 2.68 mV, and the change amount of temperature characteristic of the bandgap reference voltage generator according to an example embodiment of the present invention is only 0.87 mV. The above difference may mean that performance enhancement of about three times is achieved by the present invention.

Meanwhile, in the bandgap reference voltage generator shown in FIG. 2, a production process for NMOS transistor is necessary to make it possible to control body voltages of the third and the fourth NMOS transistors MN3 and MN4, input transistors of the amplification part 140.

Figure 6A:
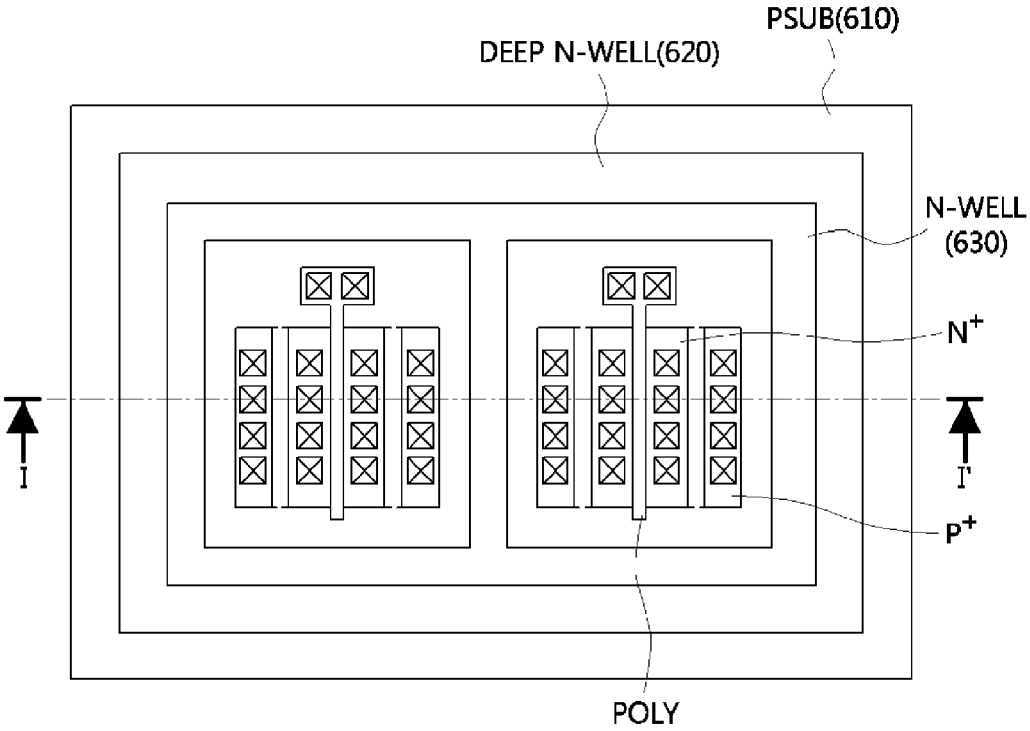
FIG. 6A and FIG. 6B is a view to show layout structure of an input transistor for an amplification part of FIG. 2.
Figure 6B:
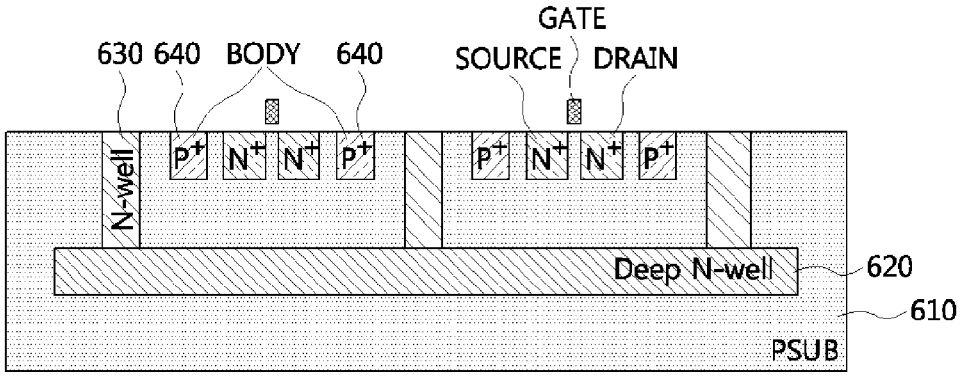

FIG. 6A and FIG. 6B is a view to show layout structure of an input transistor for an amplification part of FIG. 2.

A layout structure of NMOS transistors used as input transistors in the bandgap reference voltage generator according to an example embodiment of the present invention is shown in FIG. 6A, and FIG. 6B represents a cross section obtained through line I-I' in the layout structure of NMOS transistor shown in FIG. 6A.

Referring to FIG. 6A and FIG. 6B, a deep n-well 620 may be additionally necessary for isolating the body of NMOS from P-type substrate 610, in order to control body voltage of the NMOS transistor.

That is, after the deep n-will 620 for isolating the body of NMOS from P-type substrate 610 is implanted, n-well 630 may be constructed around to isolate the input transistor from adjacent elements. Also, it is made so that respective body voltage for each NMOS may be provided through independent P+ region contacts 640.

Meanwhile, in the case that input transistors of the amplification part 140 are configured with PMOS transistors, a procedure of body isolation shown in FIG. 6 may not be needed, and so easiness of design may be achieved.

Figure 7:
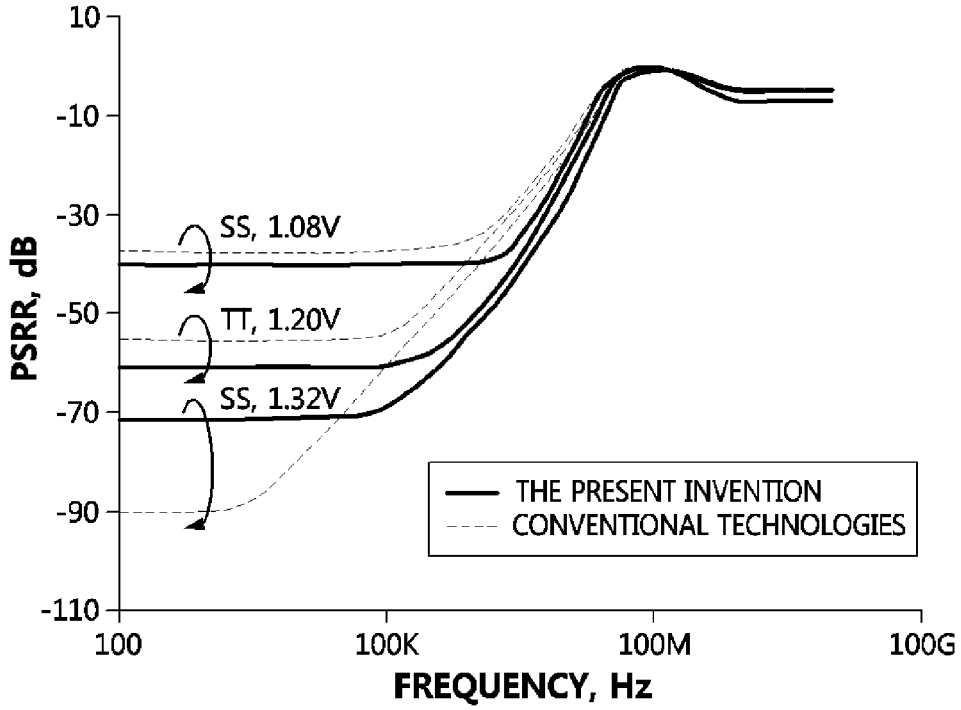
FIG. 7 is a graph to show a comparison result of PSRR characteristics of a bandgap reference voltage generator according to an example embodiment of the present invention and the conventional one.

FIG. 7 is a graph to show a comparison result of PSRR characteristics of a bandgap reference voltage generator according to an example embodiment of the present invention and the conventional one.

A power supply rejection ratio (PSRR) is information on indicating how much a change of power supply voltage affects an output reference voltage. The lower PSRR, the more robust to changes of power supply voltage.

Referring to FIG. 7, it can be found that the bandgap reference voltage generator according to an example embodiment of the present invention maintain its PSRR characteristic flat to higher frequency bands than the conventional ones. Especially, in frequency bands above 100 kHz, it can be found that the PSRR characteristic of the bandgap reference voltage generator according to an example embodiment of the present invention is more excellent than those of the conventional ones.

According to the bandgap reference voltage generator as described above, the bandgap reference voltage generator may detect current having characteristic of CTAT and current having characteristic of PTAT which flow in the current compensation part included in the amplification part, and provide body voltage to one of two input transistors included in the amplification part in response to ratio of the two currents when the ratio is different from the preconfigured reference value.

Thus, characteristics according to changes of parameters of elements and change of offset of the amplification part due to changes of PVT may be enhanced, and a characteristic of power supply rejection ratio (PSRR) may be enhanced.

While the example embodiments of the present invention and their advantages have been described in detail, it should be understood that various changes, substitutions and alterations may be made herein without departing from the scope of the invention.

What is claimed is:

1. A bandgap reference voltage generator comprising:

a current source part configured as current mirror to provide a first current, a second current, and a third current;

a first current compensation part generating a first node voltage according to the first current and compensating a change of current due to changes of at least one of process, voltage, and temperature (PVT);

a second current compensation part generating a second node voltage according to the second current and compensating a change of current due to changes of at least one of process, voltage, and temperature (PVT) by generating a fourth current and a fifth current which have change characteristics opposite to each other according to change of absolute temperature;

an amplification part comprising a first input transistor which receives the first node voltage through its gate and a second input transistor which receives the second node voltage through its gate, and outputting a voltage to drive the current source part according the first node voltage and the second node voltage;

a voltage providing part detecting amount of change in the fourth current and the fifth current, and providing body voltage to one of the first input transistor and the second input transistor according to the detected amount of change; and an output part outputting reference voltage according to the third current.

2. The bandgap reference voltage generator of claim 1, wherein the voltage providing part further comprises:

a current detecting part detecting amount of change in the fourth current and the fifth current, and generating body voltage control signal including information indicating one of the first input transistor and the second input transistor to which the body voltage is provided and information on level of the body voltage; and a body voltage control part providing the body voltage to one of the first input transistor and the second input transistor according to the body voltage control signal.

3. The bandgap reference voltage generator of claim 1, wherein the voltage providing part compares a ratio of the fourth current and the fifth current with a preconfigured reference value, and providing the body voltage to the second input transistor when the ratio is above the reference value.

4. The bandgap reference voltage generator of claim 1, wherein the voltage providing part compares a ratio of the fourth current and the fifth current with a preconfigured reference value, and providing the body voltage to the first input transistor when the ratio is below the reference value.

5. The bandgap reference voltage generator of claim 1, wherein the amplification part comprises a third PMOS transistor and a fourth PMOS transistor configured as a current-mirror, wherein respective sources of the third and the fourth PMOS transistors is connected to power supply voltage, respective drains of the third and the fourth PMOS transistors is connected to respective drains of the first and the second input transistors, a drain of the fourth PMOS transistor is connected to the current source part, and wherein the voltage to drive the current source part is changed according to the body voltage provided to one of the first input transistor and the second input transistor.

6. The bandgap reference voltage generator of claim 1, wherein the first input transistor and the second input transistor are NMOS transistors, and respective NMOS transistor in which a P+ region provided with the body voltage and a deep N-well isolating the P+ region from P-type substrate.

* * * * *